US006502260B2

(12) United States Patent
Viljoen et al.

(10) Patent No.: US 6,502,260 B2
(45) Date of Patent: Jan. 7, 2003

(54) THERAPEUTIC BED

(76) Inventors: Andre Viljoen, 137 Koljander Road, Newlands Pretoria (ZA); Pierre Viljoen, 35 Annie Street, Henneman Orange Free State (ZA)

( * ) Notice: Subject to any disclaimer, the term of this patent is extended or adjusted under 35 U.S.C. 154(b) by 138 days.

(21) Appl. No.: 09/728,216

(22) Filed: Dec. 1, 2000

(65) Prior Publication Data

US 2001/0000267 A1 Apr. 19, 2001

(30) Foreign Application Priority Data

Jun. 4, 1998 (ZA) ..... 97/10896

(51) Int. Cl.[7] ..... A61G 7/008; A61G 7/015
(52) U.S. Cl. ..... 5/607; 5/613; 5/942
(58) Field of Search ..... 5/600, 607, 613, 5/722, 942

(56) References Cited

U.S. PATENT DOCUMENTS

| | | | | | |
|---|---|---|---|---|---|
| 554,580 | A | * | 2/1896 | Conkwright | 5/618 |
| 1,740,906 | A | * | 12/1929 | Rothauszky et al. | 5/608 |
| 2,113,286 | A | * | 4/1938 | White | 5/607 |
| 2,284,470 | A | * | 5/1942 | Comper et al. | 5/602 |
| 2,522,018 | A | * | 9/1950 | Blackman | 5/607 |
| 2,613,371 | A | * | 10/1952 | Keyes, Jr. | 5/942 X |
| 2,692,173 | A | * | 10/1954 | Lowitzsch | 5/601 |
| 4,084,274 | A | * | 4/1978 | Willis et al. | 5/609 |
| 4,225,988 | A | * | 10/1980 | Cary et al. | 5/607 |
| 4,375,706 | A | * | 3/1983 | Finnhult | 5/607 |
| 4,658,450 | A | * | 4/1987 | Thompson | 5/607 |
| 4,658,451 | A | * | 4/1987 | Taniguchi | 5/607 |
| 4,731,889 | A | * | 3/1988 | Ishikawa | 5/607 |
| 4,908,844 | A | * | 3/1990 | Hasegawa | 5/607 X |
| 5,101,519 | A | * | 4/1992 | Yamamoto | 5/942 X |
| 5,125,122 | A | * | 6/1992 | Chen | 5/607 X |
| 5,181,288 | A | * | 1/1993 | Heaton et al. | 5/607 |
| 5,224,228 | A | * | 7/1993 | Larrimore | 5/613 |
| 5,303,437 | A | * | 4/1994 | Hung | 5/613 |
| 5,392,479 | A | * | 2/1995 | Liao | 5/607 X |
| 5,479,665 | A | | 1/1996 | Cassidy et al. | 5/613 |
| 5,515,561 | A | * | 5/1996 | Suggitt et al. | 5/607 |
| 5,535,464 | A | * | 7/1996 | Salonica | 5/604 |
| 5,608,932 | A | * | 3/1997 | Hasegawa | 5/611 |
| 5,640,729 | A | * | 6/1997 | Marino | 5/607 |
| 5,699,566 | A | * | 12/1997 | Chuang | 5/613 |
| 5,826,286 | A | * | 10/1998 | Cranston | 5/606 |
| 6,038,717 | A | * | 3/2000 | Persson | 5/607 |
| 6,360,386 | B1 | * | 3/2002 | Chuang | 5/618 |
| 2001/0000267 | A1 | * | 4/2001 | Vijoen et al. | 5/600 |

FOREIGN PATENT DOCUMENTS

| | | |
|---|---|---|
| DE | 1 943 816 | 11/1970 |
| EP | 0 183 371 | 4/1986 |
| EP | 0 635 250 | 1/1995 |
| WO | WO 86/03663 | * 7/1986 |

* cited by examiner

*Primary Examiner*—Robert G. Santos
(74) *Attorney, Agent, or Firm*—Akerman Senterfitt

(57) ABSTRACT

The invention provides a bed (10) for relieving pressure exerted on a user. The bed includes a first support means (12) for supporting the user, a second support means (14) which is co-operable with the first support means (12), and a displacement means (32) for displacing the user between a first position wherein the user is supported by the first support means (12) and a second position wherein the user is supported by the first and second support means. Typically the user is an aged person, an infirm person, an incapacitated person, a patient, or the like.

20 Claims, 3 Drawing Sheets

THERAPEUTIC BED

FIELD OF THE INVENTION

This invention relates to a bed, and in particular, to a bed for relieving pressure exerted on a user by the bed.

BACKGROUND ART TO THE INVENTION

The inventor is aware that a medical problem often associated with long periods of bed rest, as well as with the inability to shift a users position in a conventional bed, are bed sores or pressure sores caused by the pressure exerted by the bed on the user.

DISCLOSURE OF THE INVENTION

According to the invention there is provided a bed for relieving pressure exerted on a user, which bed includes:

a first support means for supporting the user;

a second support means which is co-operable with the first support means; and a displacement means for displacing the user between a first position wherein the user is supported by the first support means and a second position wherein the user is supported by the first and second support means.

Typically the user is an aged person, an infirm person, an incapacitated person, a patient, or the like.

The bed may include a base with caster wheels to facilitate displacement of the bed.

The bed may include a third support means which is co-operable with the first support means on the opposite side to which the second support means is connected to the first support means, thereby permitting the user to be supported by the first support means, the first and second support means, or the first and third support means.

The second and third support means may be hingedly connected to the first support means.

The bed may further include a retaining means which is adapted to extend between the first and second or between the first and third supporting means to retain the second or third support means in a predetermined position relative to the first support means. In particular, the retaining means permits retention of the first, second and third support means in the same plane in an inoperative condition, and retention of the second or third support means at an angle relative to the first support means in an operative supporting condition wherein the user is simultaneously supported by both the first and second support means or the first and third support means respectively.

The retaining means may be removable to permit the second and third support means to be lowered to facilitate access to the user.

The retaining means may be a chain spanning between the first and second support means and/or first and third support means, such that a substantial portion of the weight of a user bearing on the second and/or third support means is carried by the chain.

The chain may be of a length longer than that required to permit the first and second support means and/or first and third support means to support the user between them, the additional length being taken up by a resiliently biassed tensioning device, such as a coil spring, acting between two or more remote links of the chain.

The retaining means may however include a member mounted pivotably on the longitudinal axis of the first support means and extending laterally therefrom to support the second and/or third support means thereon.

The retaining means may include a mechanism for pivoting the member from the plane of the first support to permit the second and/or third support member to be displaced from a user supporting position to a position which facilitates access to the user.

The mechanism may include a bendix type drive.

The bed may include a plurality of mattresses, preferably having one mattress placed on each support means. However, the bed may include a plurality of mattresses distributed at least one per support means.

The mattresses may be segmented. Typically the matress on the first support means is of the segmented type.

The mattress on the first support means may have an aperture therethrough to permit the passing of a tube, such as a catheter, or an electrical cable, such as that for a monitoring device. Typically the aperture will be located between two adjacent segments of the segmented matress.

The first support means may include a plurality of segments, preferably hinged, so that the user may be positioned in a semi-upright or seated position.

The displacement means may be adapted to rotate and/or pivot the first support means, and with it the second and third support means, about a longitudinal axis of the first support means.

However, the displacement means may comprise telescoping extension rods configured to displace the second support means and/or the third support means relative to the first support means thereby to displace the user.

The displacement means and the mechanism for pivoting the retaining member may co-operate to facilitate both operations to be carried out together.

The bed may be elevated to a semi-upright position by a second displacement means which extends between the base and the first support means, wherein the first support means, and with it the second and third support means, is capable of being displaced by the second displacement means about a pivotal point on the base of the bed between a first horizontal position and an elevated position wherein the bed is inclined relative to the ground to permit the user to be supported in an elevated position.

Embodiments of the invention will now be described by way of example with reference to the accompanying drawings.

In the drawings

Figure 1:
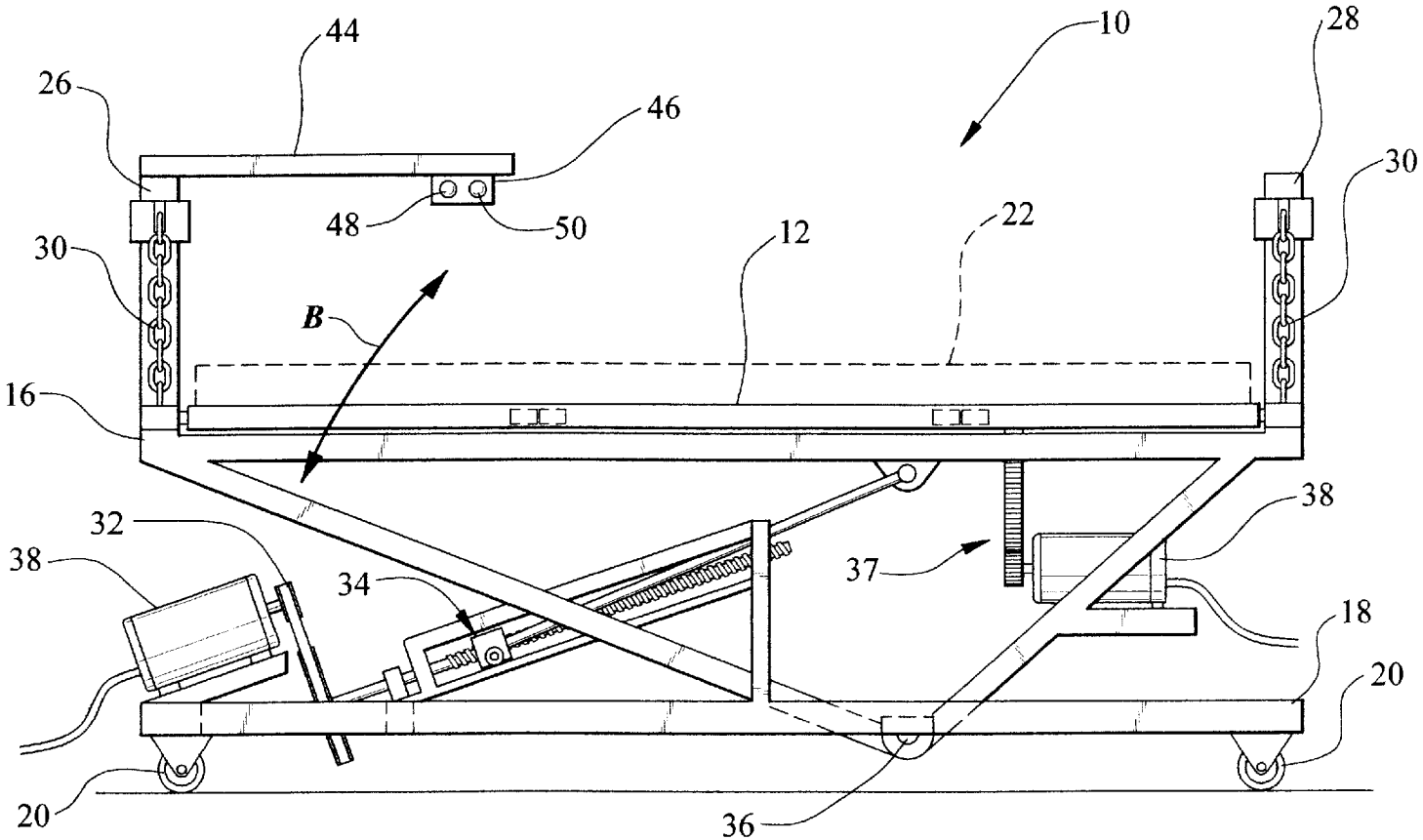
FIG. 1 shows a side view of a bed in accordance with the invention.

In the drawings, reference numeral 10 generally indicates a bed in accordance with the invention.

Figure 2:
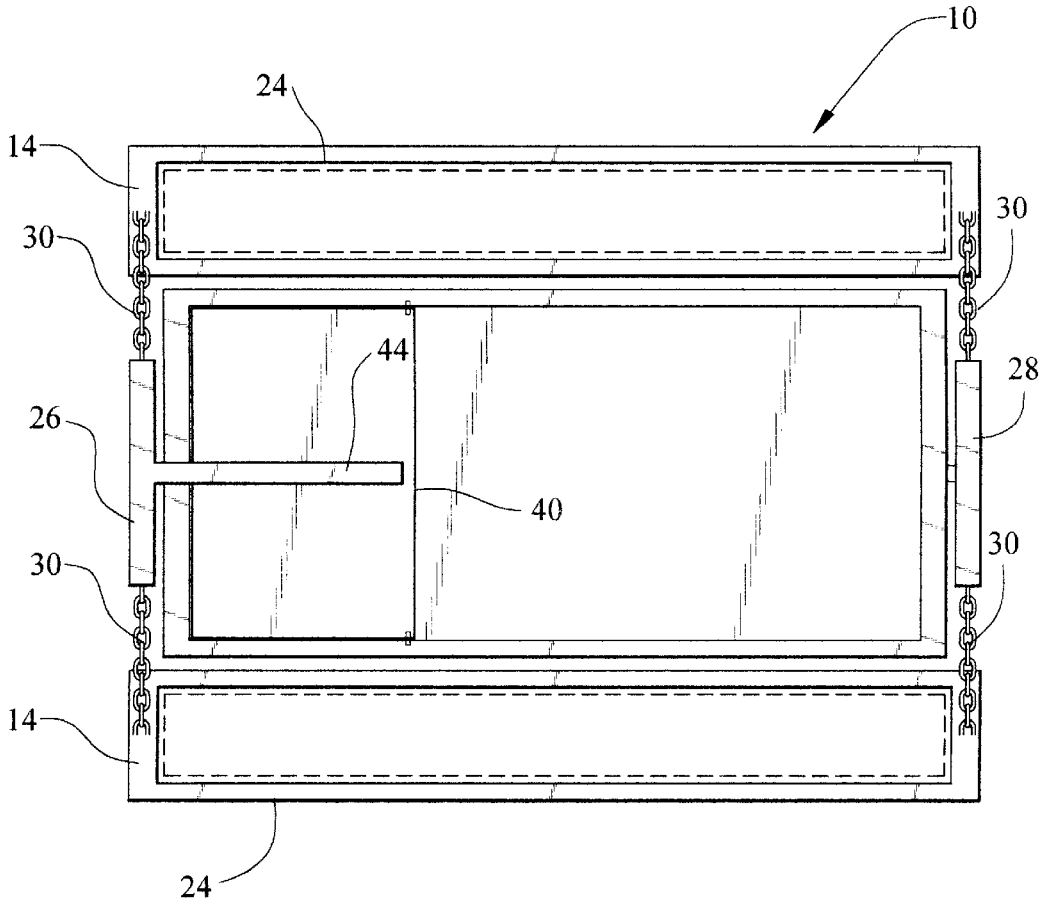
FIG. 2 shows a plan view of the bed in accordance with the invention.
Figure 3:
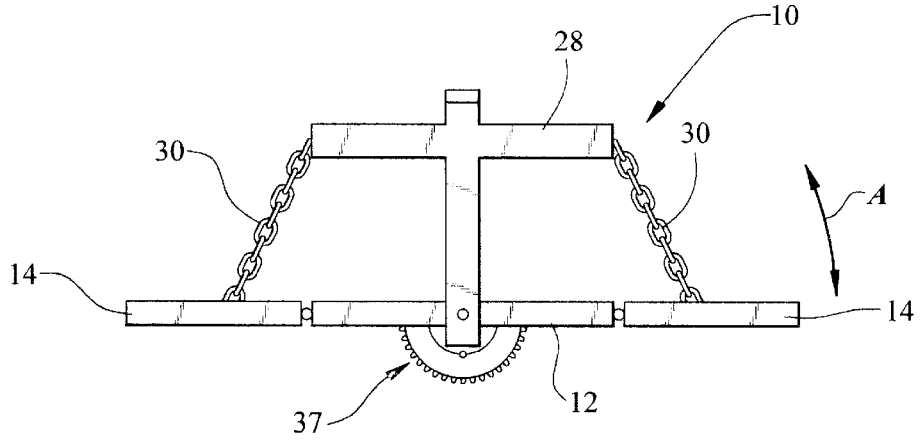
FIG. 3 shows a partial end view of the bed.

Referring now to FIGS. 1 to 3, the bed 10 includes a central support 12 and a pair of side supports 14 for supporting a user. The central support 12 is mounted on a frame 16 which is mounted pivotally on a base 18 having caster wheels 20 to permit displacement of the bed 10 in use.

The central support 12 and side supports 14 are hingedly connected. Foam mattresses 22 and 24 are arranged on the central and side supports 12 and 14 respectively. Upwardly extending arms 26 and 28 extend from the ends of the central support 12. Retaining means in the form of removable chains 30 interconnect the arms 26, 28 and side supports 14 to retain the side supports 14 in the same plane as the central support 12 in an inoperative condition. The chains 30 can be detached to permit the side supports 14 to be pivoted downwardly relative to the central support 12 to permit a user to be easily received by or removed from the bed 10, and for attendants or medical staff to approach and gain access to the user on the bed and, for example, administer treatment to the user. In operation, when the central support 12 is pivoted about its longitudinal axis, the chains 30 serve to displace at least one of the side supports 14 in the direction of arrow A towards the central support 12 to enable the user to be supported at least partially by one of the side supports 14 and central support 12.

A first displacement means comprising a driven belt assembly 32 for rotating a threaded shaft and collar assembly 34 is provided to displace pivotally the frame 16 and with it the supports 12 and 14 about a pivot point 36 on the base 18 in the direction of arrow B to enable the user to be moved between a horizontal and inclined position to facilitate his comfort, circulation and pressure relief.

In other embodiments, not shown, the first displacement means comprises a chain drive or a direct drive. The first displacement means may be operated electrically, pneumatically, hydraulically, or by a combination of one or more of the preceding.

A second displacement means comprising a driven rack and pinion assembly 37 is provided to facilitate pivotal displacement in the direction of arrow A of the central and side supports 12 and 14 in the manner as hereinbefore described.

The assemblies 32 and 37 are powered by electric motors 38.

Figure 4:
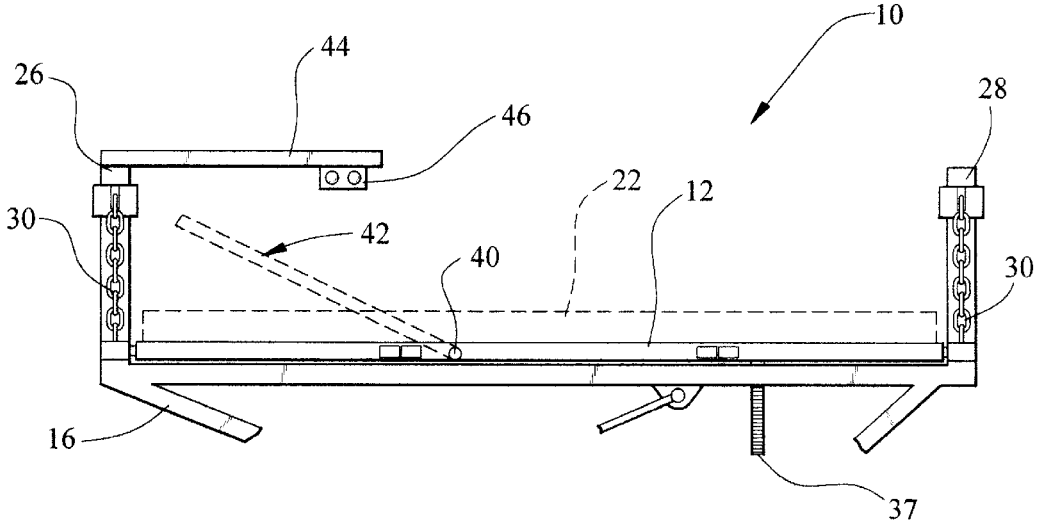
FIG. 4 shows a partial side view of a further embodiment of a bed in accordance with the invention.

In another embodiment of the invention shown in FIG. 4, the central support 12 comprises hinged segments 40 to permit the user to be arranged in a semi-upright position 42 (in dotted lines) or a seated position (not shown).

A horizontal beam 44 partially extends from the upright arm 26 over the bed 10, however, in other embodiments the beam 44 may extend from the head of the bed (not shown).

A switch box 46 is attached to the underneath side of the beam 44 to permit displacement of the bed 10 to be controlled by the user, however, in other embodiments (not shown) the beam 44 may extend from the foot of the bed and the switch box 46 is located at the foot of the bed and a voice control microphone is located at the head of the bed.

The switch box 46 has a switch 48 for controlling the vertical displacement (arrow B) and another switch 50 controlling the longitudinal, rotational or pivotal displacement (arrow A) of the bed 10.

The bed 10 also includes safety features in the form of safety straps (not shown) for confining the user to the bed 10 and reducing the risk of injury to the user when the bed 10 is displaced.

The bed 10 may also include a plurality of panels (not shown) which surround the frame 16 to give the bed 10 an aesthetic appearance.

The applicant believes that the bed in accordance with the invention will provide a simplified solution for alleviation of pressure and consequent bedsores, often experienced by quadriplegics, paraplegics, the elderly and patients. The physical rotation of the body has definite advantages for blood circulation, bladder and bowel function. The increased pressure exerted on a disabled person's legs when in an upright position may also inhibit the progress of osteoporosis.

The invention is not limited to the precise constructional details as hereinbefore described. For example, the first displacement means may be in the form of telescoping extension rods. The pivotal displacement of the supports about their longitudinal axes may be carried out manually by an assistant. A voice activated computer means which is connectable to the first and second displacement means may also be provided to permit voice activation of said displacement means.

What is claimed is:

1. A bed for relieving pressure exerted on a user, which bed includes:

a first support means for supporting the user;

a second support means which is connected at a first end to the first support means and suspended by means of a retaining means extending between a location on the second means away from the first end and an arm extending from a frame portion of the bed, so that the second support means moves in sympathy with the first support means when the first support means is laterally displaced; and a rack and pinion for pivotally displacing the first support means towards the second support means, the second support means thereby moving in an opposite direction to the first support means so that the user would be displaced between a first position wherein the user would be supported by the first support means and a second position wherein the user would be supported by the first and second support means.

2. A bed as claimed in claim 1, further including a third support means which is connected at a first end to a side of the first support means which is opposite to the side at which the second support means is connected, the third support means being suspended by a retaining means extending between a location on the third support means away from the first end and the arm extending from the frame portion, so that the third support means moves in sympathy with the first support means in an opposite direction to the first support means.

3. A bed as claimed in claim 1, wherein the retaining means is disengageable to permit the second and/or third support means to be rotated so that a distal edge thereof is downwardly displaceable.

4. A bed as claimed in claim 2, wherein the retaining means is disengageable to permit the second and/or third support means to be rotated so that a distal edge thereof is downwardly displaceable.

5. A bed as claimed in claim 1, wherein the second and third support means are hingedly connected to the first support means.

6. A bed as claimed in claim 1, wherein the retaining means permits retention of the second and third support means in substantially the same plane as the first support means in an inoperative condition, and retention of the second or third support means at an angle relative to the first support means in an operative supporting condition wherein the user would be simultaneously supported by both the first and second support means or the first and third support means respectively.

7. A bed as claimed in claim 1, including a base with caster wheels to facilitate displacement of the bed.

8. A bed as claimed in claim 1, wherein the retaining means is a chain.

9. A bed as claimed in claim 2, wherein the retaining means is a chain.

10. A bed as claimed in claim 3, wherein the retaining means is a chain.

11. A bed as claimed in claim 4, wherein the retaining means is a chain.

12. A bed as claimed in claim 8, wherein the chain is of a length longer than that required to permit the first and second support means and/or first and third support means to support the user between them, the additional length being taken up by a resiliently biased tensioning device acting between two or more remote links of the chain.

13. A bed as claimed in claim 9, wherein the chain is of a length longer than that required to permit the first and second support means and/or first and third support means to support the user between them, the additional length being taken up by a resiliently biased tensioning device acting between two or more remote, links of the chain.

14. A bed as claimed in claim 10, wherein the chain is of a length longer than that required to permit the first and second support means and/or first and third support means to support the user between them, the additional length being taken up by a resiliently biased tensioning device acting between two or more remote links of the chain.

15. A bed as claimed in claim 1, wherein the first support means includes a plurality of segments.

16. A bed as claimed in claim 15, wherein the plurality of segments are hingedly connected so that the user may be positioned in a semi-upright or seated position.

17. A bed as claimed in claim 7, wherein the bed is adapted to be elevated to a semi-upright position by a second displacement means which extends between the base and the frame portion, wherein the frame portion together with the first, second and third support means, is capable of being displaced by the second displacement means about a pivotal point on the base of the bed between a first horizontal position and an elevated position wherein the bed is inclined relative to the ground to permit the user to be supported in an elevated position.

18. A bed as claimed in claim 1, including a segmented mattress on the first support means.

19. A bed as claimed in claim 16, wherein the segmented mattress has three segments configured to permit the segments under the torso and head of a user to be displaceable independently.

20. A bed as claimed in claim 18, wherein an aperture is provided between at least two of the segments for passing a tube or a cable therethough.

* * * * *